US010541483B2

(12) United States Patent
Hirata et al.

(10) Patent No.: US 10,541,483 B2
(45) Date of Patent: Jan. 21, 2020

(54) PLUG CONNECTOR

(71) Applicant: KYOCERA CORPORATION, Kyoto (JP)

(72) Inventors: Kirara Hirata, Guangdong (CN); Toshiaki Sugiki, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/749,765

(22) PCT Filed: Jun. 29, 2016

(86) PCT No.: PCT/JP2016/003125
§ 371 (c)(1),
(2) Date: Feb. 1, 2018

(87) PCT Pub. No.: WO2017/022171
PCT Pub. Date: Feb. 9, 2017

(65) Prior Publication Data

US 2019/0020133 A1 Jan. 17, 2019

(30) Foreign Application Priority Data

Aug. 5, 2015 (JP) ..... 2015-154863

(51) Int. Cl.
*H01R 12/71* (2011.01)
*H01R 12/70* (2011.01)
(Continued)

(52) U.S. Cl.
CPC ..... *H01R 12/716* (2013.01); *H01R 12/7005* (2013.01); *H01R 12/707* (2013.01);
(Continued)

(58) Field of Classification Search
CPC .... H01R 23/725; H01R 9/096; H01R 12/716; H01R 12/7005; H01R 12/73;
(Continued)

(56) References Cited

U.S. PATENT DOCUMENTS 5,928,003 A * 7/1999 Kajinuma ..... H01R 12/716 439/248
6,325,644 B1 * 12/2001 Lemke ..... H01R 12/57 439/83
(Continued)

FOREIGN PATENT DOCUMENTS

CN 104112947 A 10/2014
JP 2013206771 A 10/2013
(Continued)

OTHER PUBLICATIONS

International Search Report/Written Opinion dated Oct. 4, 2016, in corresponding International Application No. PCT/JP2016/003125 with Statement of Relevance of Non-English References.

*Primary Examiner* — Gary F Paumen
(74) *Attorney, Agent, or Firm* — Duane Morris LLP

(57) ABSTRACT

Provided is a plug connector having an insulator and a plug connector fixing bracket that is hard to collapse (break). A plug connector (15) is attachable to and detachable from a receptacle connector (35) and includes: a plug insulator having an outer wall that includes a pair of longitudinal walls and a pair of transverse walls together constituting an annular projection engageable with an engagement recess of the receptacle connector (35); a plug contact group arranged in a row and supported by the longitudinal wall of the outer peripheral wall, contacts a receptacle contact group when the annular projection is fit into the engagement recess, and is connected to a circuit pattern of a plug side circuit board; and a plug connector fixing bracket mounted on the transverse walls. The plug connector fixing bracket includes a
(Continued)

receiving surface facing a bottom surface of the transverse walls, a transverse outer wall and a transverse inner wall that bend from the receiving surface and respectively extend along an inner surface and an outer surface of the transverse walls, and a pair of longitudinal outer walls that bends from the receiving surface and extends along outer surfaces of the longitudinal walls.

5 Claims, 14 Drawing Sheets

(51) Int. Cl.
*H01R 12/73* (2011.01)
*H01R 24/60* (2011.01)
*H01R 43/26* (2006.01)

(52) U.S. Cl.
CPC ..... *H01R 12/7029* (2013.01); *H01R 12/73* (2013.01); *H01R 24/60* (2013.01); *H01R 43/26* (2013.01); *H01R 12/7088* (2013.01)

(58) Field of Classification Search
CPC ..... H01R 12/7029; H01R 12/707; H01R 12/7088; H01R 24/60; H01R 43/26
USPC ..... 439/74, 569, 571
See application file for complete search history.

(56) References Cited

U.S. PATENT DOCUMENTS

| | | | | |
|---|---|---|---|---|
| 6,733,343 | B2 * | 5/2004 | Morita | H01R 13/6456 439/680 |
| 9,350,095 | B2 | 5/2016 | Arichika et al. | |
| 9,577,379 | B2 | 2/2017 | Arichika et al. | |
| 2004/0014335 | A1 * | 1/2004 | Igarashi | H01R 12/716 439/74 |
| 2011/0070752 | A1 * | 3/2011 | Yamashiro | H01R 12/57 439/83 |
| 2013/0012039 | A1 * | 1/2013 | Nose | H01R 12/716 439/74 |
| 2013/0084759 | A1 * | 4/2013 | Mizuta | H01R 13/03 439/733.1 |
| 2013/0330943 | A1 * | 12/2013 | Sasaki | H01R 13/631 439/74 |
| 2015/0064942 | A1 * | 3/2015 | Takemoto | H01R 12/7029 439/74 |
| 2015/0140841 | A1 * | 5/2015 | Watanabe | H01R 12/7011 439/74 |
| 2015/0263464 | A1 | 9/2015 | Arichika et al. | |
| 2016/0268732 | A1 | 9/2016 | Arichika et al. | |
| 2016/0315430 | A1 * | 10/2016 | Takeuchi | H01R 12/707 |

FOREIGN PATENT DOCUMENTS

| | | | |
|---|---|---|---|
| JP | 2014038768 | A | 2/2014 |
| JP | 2014212040 | A | 11/2014 |
| KR | 20150068919 | A | 6/2015 |

* cited by examiner

PLUG CONNECTOR

CROSS REFERENCE TO RELATED APPLICATION

This application claims priority to and the benefit of Japanese Patent Application No. 2015-154863 filed on Aug. 5, 2015, the entire contents of which are incorporated herein by reference.

TECHNICAL FIELD

The present disclosure relates to a connector commonly used to couple substrates together and, in particular, to a plug connector attachable to and detachable from a receptacle connector.

BACKGROUND

Electric devices and electronic devices, including standalone PCs (personal computers), laptop PCs, mobile terminals such as smartphones, and tablet PCs, are commonly equipped with a circuit board with electronic components mounted thereon and another circuit board with other electronic components mounted thereon.

A connector described in PLT 1 set forth below is a connector for coupling these two circuit boards together and includes a receptacle connector mounted on a circuit board (a rigid board) and a plug connector mounted on another circuit board (a rigid board). The receptacle connector includes a receptacle insulator, a plurality of receptacle contacts, and a pair of receptacle connector fixing brackets. The receptacle insulator includes an annular outer peripheral wall and an annular engagement recess formed inside the outer peripheral wall. A plurality of receptacle contacts are aligned in a longitudinal direction of the receptacle connector and supported by the receptacle insulator. The pair of receptacle connector fixing brackets is fixed to the receptacle insulator.

On the other hand, the plug connector includes a plug insulator, a plurality of plug contacts, and a pair of plug connector fixing brackets. The plug insulator includes an annular projection formed by an annular wall that can fit into the engagement recess mentioned above. Each of the plug contacts may be coupled to a circuit pattern on a mounting surface of the circuit board. The plug connector fixing brackets may be coupled to a conduction detection pattern formed on the mounting surface.

When the annular projection of the plug connector is fitted into (coupled to) the engagement recess of the receptacle connector, the plug contacts come into contact with the corresponding receptacle contacts. Thus, the electronic components mounted on the circuit board having the receptacle connector mounted thereon and the electronic components mounted on the circuit board having the plug connector mounted thereon are electrically connected to each other.

When recesses formed on a surface of the plug contacts are engaged with protrusions formed on the receptacle contact, the plug connector fixing bracket contacts an elastic contact member of the receptacle connector fixing bracket. As a result, the conduction detection pattern of the circuit board having the receptacle connector mounted thereon and the conduction detection pattern of the circuit board having the plug connector mounted thereon electrically connect to each other. Thus, the connection between the receptacle contacts and the plug contacts (the electrical connection between the circuit pattern of the circuit board having the receptacle connector mounted thereon and the circuit pattern of the circuit board having the plug connector mounted thereon) can be realized.

CITATION LIST

Patent Literature

PLT 1: JP-A-2013-206771

SUMMARY

Technical Problem

In the connector described in the PLT 1, the annular wall (the annular projection) of the plug insulator includes the transverse walls positioned at either end in a left and right direction (left and right walls) and a pair of longitudinal walls (front and rear walls) that extend in the left and right direction in a manner connecting ends of the transverse walls together. The plug connector fixing brackets are fixed to the transverse walls. In particular, the annular projection of the plug insulator is fit in the engagement recess of the receptacle connector and thus is formed to be smaller than the receptacle connector. In response to a demand for a reduction in a size of a connector for connecting between the substrates, a size of the plug connector fixing bracket is further reduced, and the annular wall of the plug insulator is formed to be thin and small. Accordingly, there is a high risk of breakage (collapse) of the plug connector fixing bracket or the annular wall.

Therefore, it could be helpful to provide a plug connector having an insulator or a plug connector fixing bracket that are hard to collapse (break).

Solution to Problem

A plug connector according to the present disclosure is a plug connector attachable to and detachable from a receptacle connector. The receptacle connector includes: a receptacle insulator made of resin and having an annular outer peripheral wall that forms an engagement recess inside thereof; and a receptacle contact group that is elastically deformable, mountable on a circuit pattern of a receptacle side circuit board, and supported by the receptacle insulator. The plug connector includes: a plug insulator having an outer wall that includes a pair of longitudinal walls and a pair of transverse walls together constituting an annular projection that may be fit into the engagement recess; a plug contact group that is arranged in a row and supported by the longitudinal wall of the outer peripheral wall, contacts the receptacle contact group when the annular projection is fit into the engagement recess, and is connected to a circuit pattern of a plug side circuit board; and a plug connector fixing bracket mounted on the transverse walls. The plug connector fixing bracket includes a receiving surface facing a bottom surface of the transverse walls, a transverse outer wall and a transverse inner wall that bend from the receiving surface and respectively extend along an outer surface and an inner surface of the transverse walls, and a pair of longitudinal outer walls that bends from the receiving surface and extends along outer surfaces of the longitudinal walls.

Preferably, the pair of longitudinal outer walls of the plug connector fixing bracket has a length in a longitudinal direction along the longitudinal wall equal to or shorter than a length in the longitudinal direction between the transverse outer wall and the transverse inner wall.

One of the transverse outer wall and the transverse inner wall of the plug connector fixing bracket may include a pair of separated walls located across a center of a longitudinal direction of the transverse walls of the plug insulator.

It is practical that, the transverse outer wall of the plug connector fixing bracket includes the pair of separated walls located across the center of the longitudinal direction of the transverse walls of the plug insulator.

The pair of transverse walls of the plug insulator each include a pair of fixing bracket mounting grooves to engage with the pair of separated walls.

Preferably, at least one of the transverse outer wall and the transverse inner wall and the pair of longitudinal outer walls bend from the receiving surface and linearly extend such that a top end portions thereof contact the plug side circuit board.

The transverse inner wall may be inserted into a bottomed hole formed on a top plate of the plug insulator.

The transverse inner wall is inserted into a through hole formed on the top plate of the plug insulator and contacts the plug side circuit board.

The transverse inner wall may include a narrow portion.

Preferably, the narrow portion of the transverse inner wall corresponds to a height of solder-wicking preventing portions formed between the receiving surface and gold-plated portions of the pair of longitudinal outer walls mounted on the plug side circuit board.

It is practical that the plug insulator of the plug connector according to the present disclosure includes grooves to engage with the transverse outer wall, the transverse inner wall, and the pair of longitudinal outer walls.

Advantageous Effect

The plug connector according to the present disclosure includes the plug connector fixing brackets that may sufficiently reinforce the transverse walls of the plug insulator and prevent the plug insulator from breaking.

DETAILED DESCRIPTION

Hereinafter, an embodiment according to the present disclosure will be described with reference to the accompanying drawings. In the following description, the front-rear, left-right and up-down directions correspond to the directions indicated by arrows in the figures.

Figure 5:
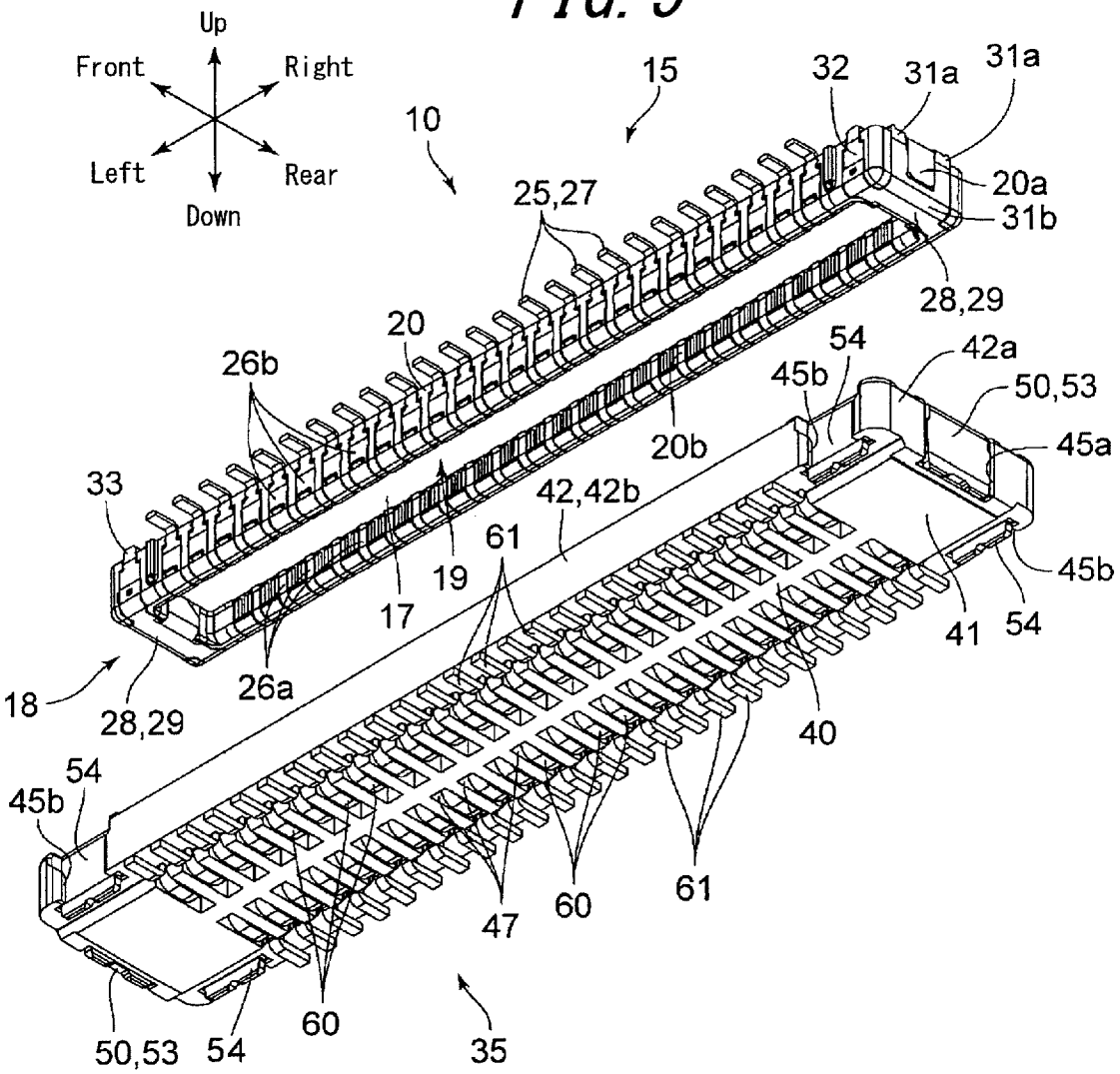
FIG. 5 is a perspective view illustrating a state in which the plug connector is placed close to a receptacle connector, viewed from below.
Figure 6:
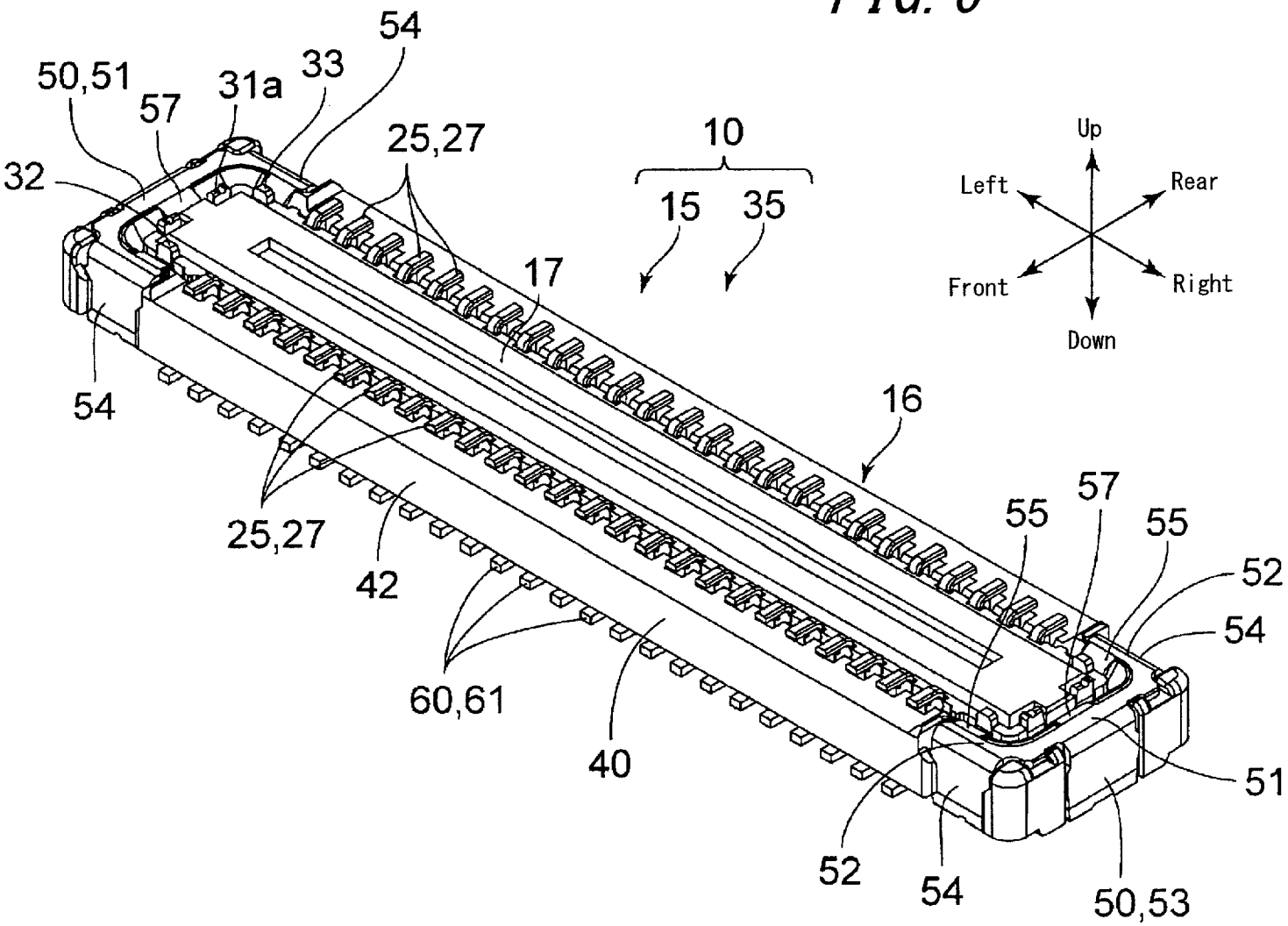
FIG. 6 is a perspective view illustrating a state in which the receptacle connector and the plug connector are fully engaged, viewed from above.
Figure 7:
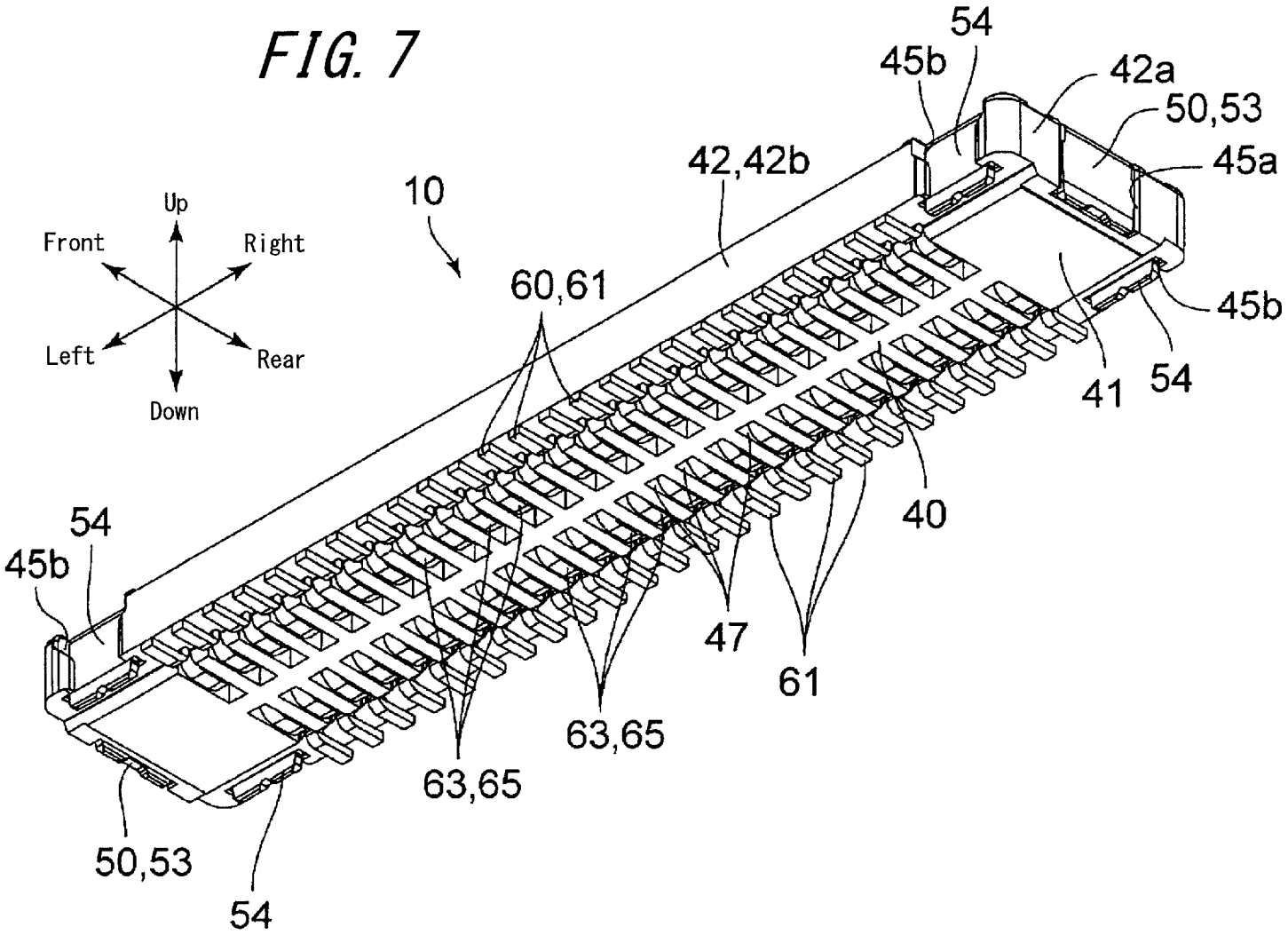
FIG. 7 is a perspective view illustrating the state in which the receptacle connector and the plug connector are fully engaged, viewed from below.
Figure 8A:
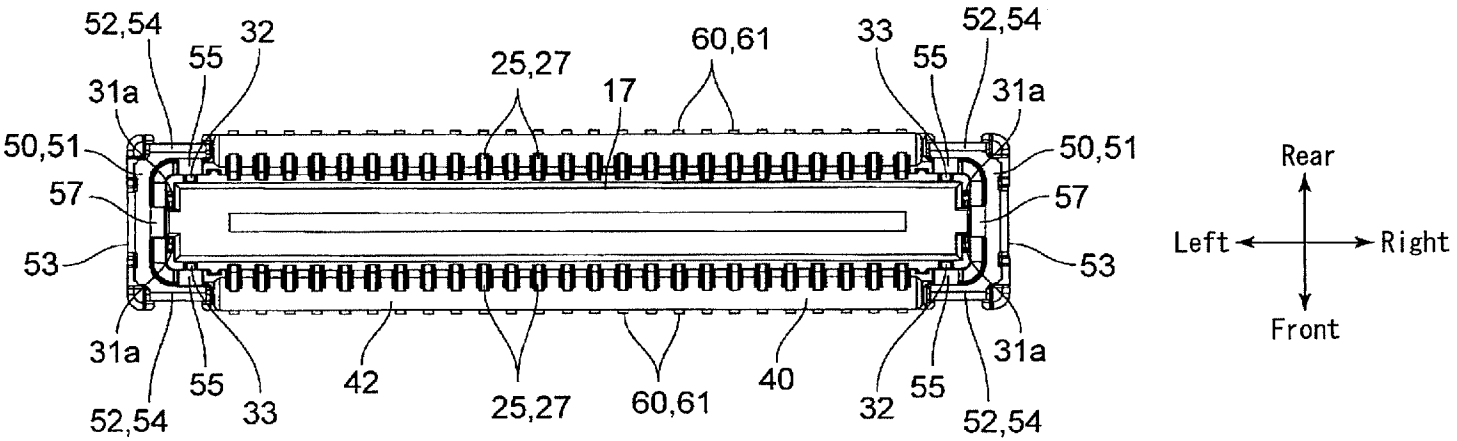
FIG. 8A is a plan view (a top view) illustrating the state of the receptacle connector and the plug connector are fully engaged.
Figure 8B:
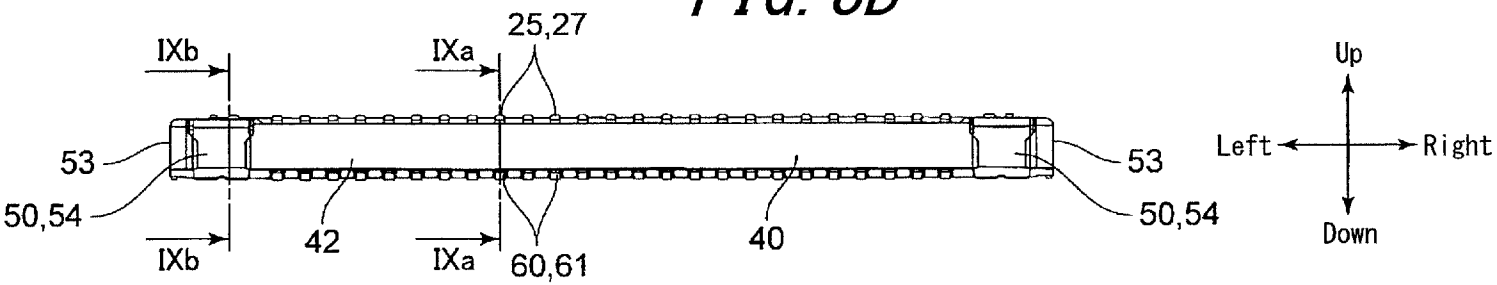
FIG. 8B is an elevation view illustrating the state of the receptacle connector and the plug connector are fully engaged.

A connector 10 according to the present embodiment includes a plug connector 15 and a receptacle connector 35 (see FIG. 5 to FIG. 7).

As illustrated mainly in FIG. 1 to FIG. 5 and FIGS. 10A and 10B, the plug connector 15 includes, as major components, a plug insulator 16, a number of plug contacts 25 (a plug contact group), and two plug connector fixing brackets 28.

The plug insulator 16 is a rod-like member made of synthetic resin having insulating and heat-resistant properties and extending in the left-right direction. The plug insulator 16 includes a top plate 17 constituting an upper end of the plug insulator 16, and an annular projection 18 that includes an annular wall 20 projecting downward from an entire perimeter of a bottom surface of the top plate 17.

The annular wall 20 includes transverse walls 20*a* (left and right walls) positioned at either end in the left-right direction, and a pair of longitudinal walls 20*b* (front and rear walls) that extends in the left-right direction and connects both ends of the transverse walls 20*a*. Weld lines WL (see FIG. 1 and FIG. 2) tend to occur at center portions in the longitudinal direction of the transverse walls 20*a* when the plug insulator 16 is injection molded by injecting a molten material from the center portion in the left-right direction.

Figure 1:
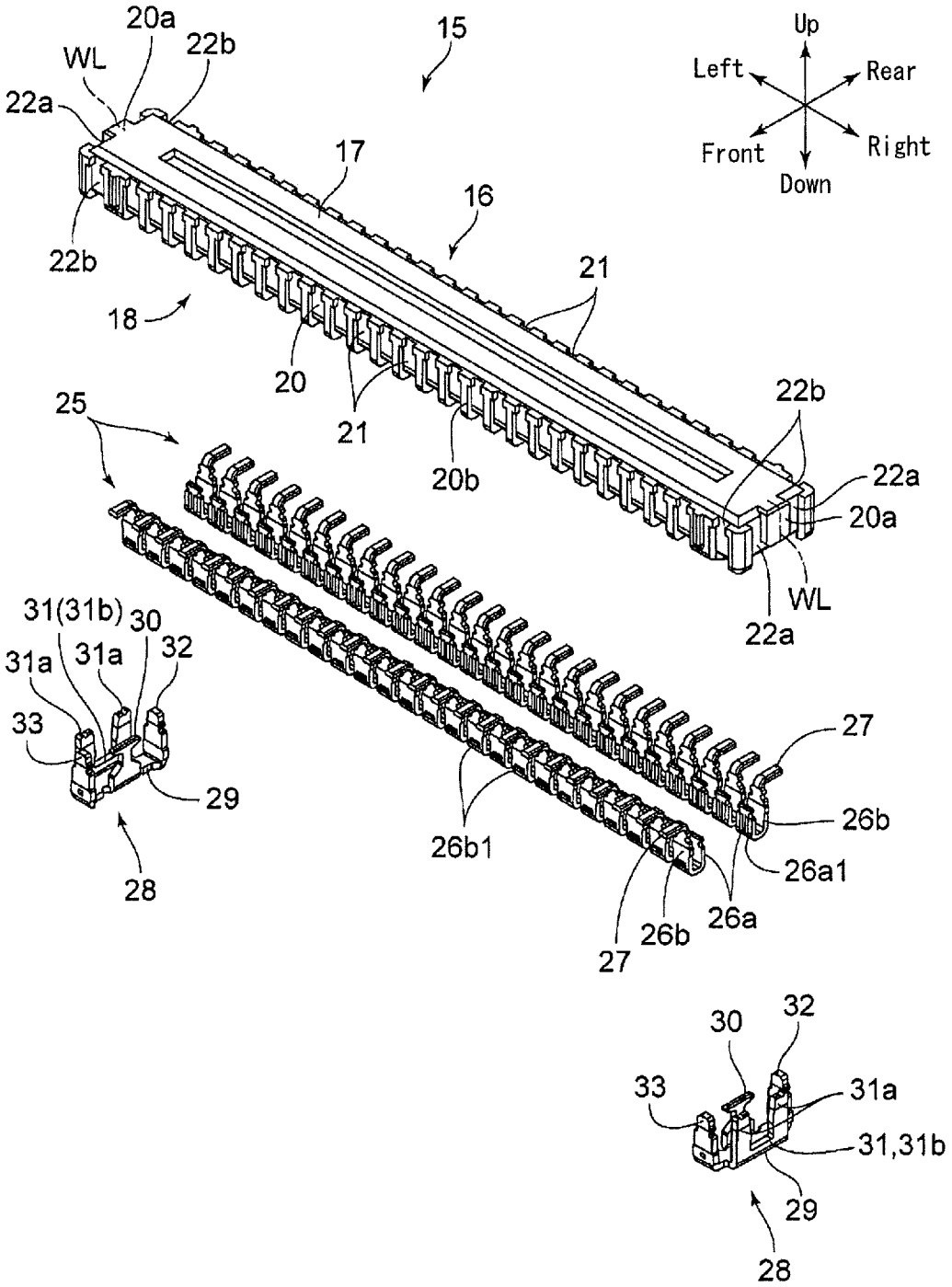
FIG. 1 is an exploded perspective view illustrating a plug connector according to an embodiment of the present disclosure, viewed from above.
Figure 2:
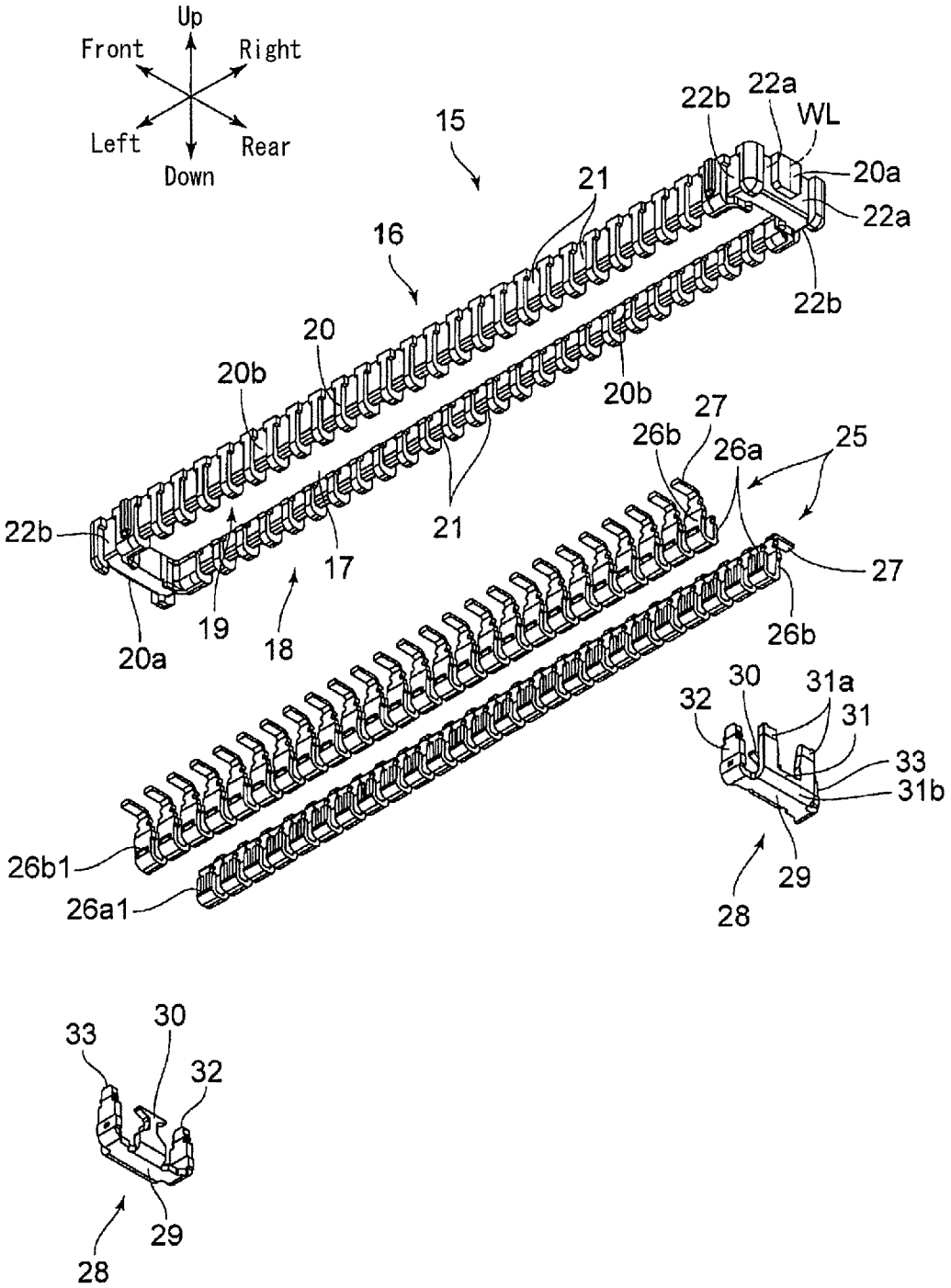
FIG. 2 is an exploded perspective view illustrating the plug connector, viewed from below.
Figure 3:
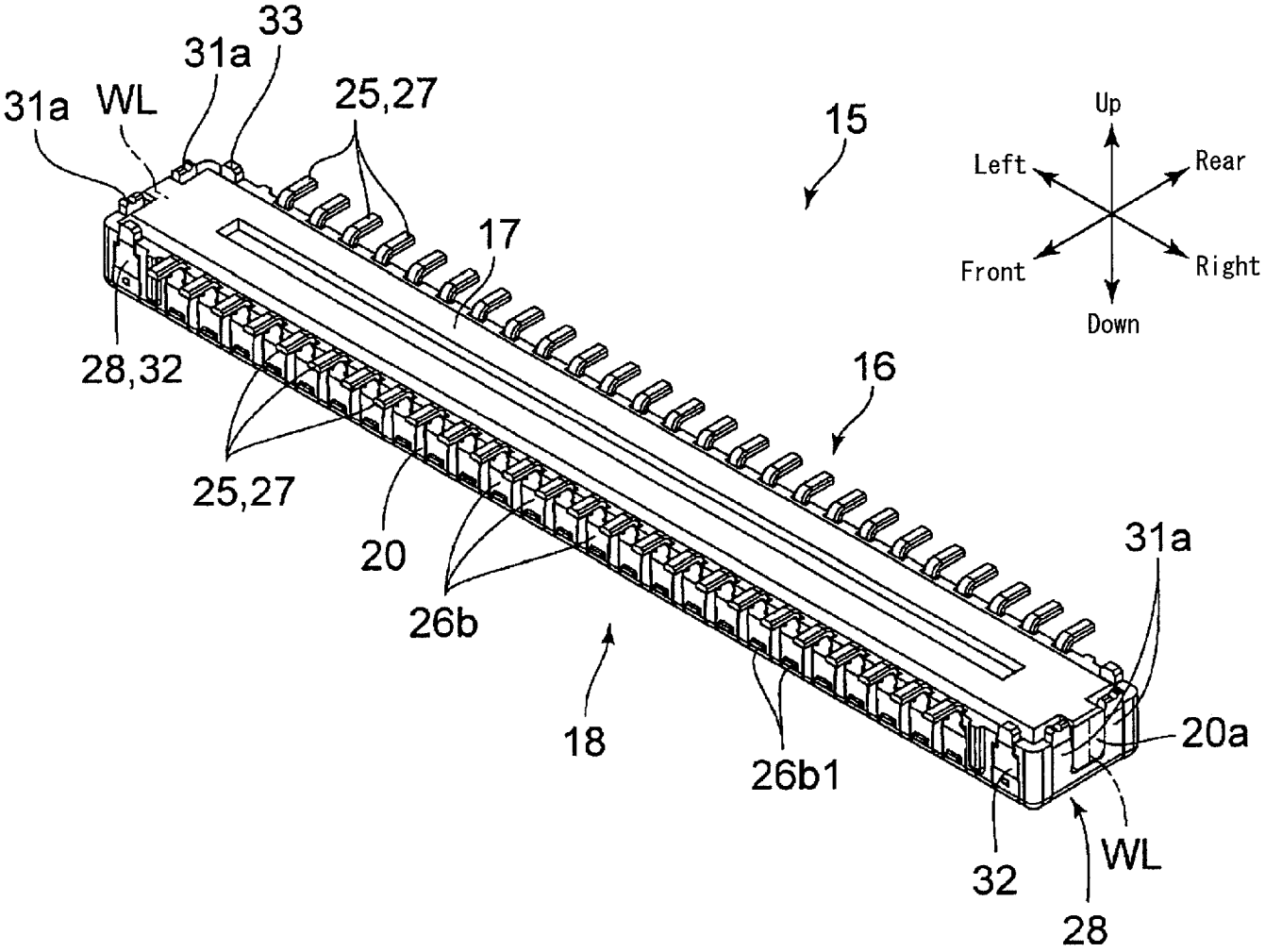
FIG. 3 is an exploded perspective view illustrating the plug connector, viewed from above.
Figure 4:
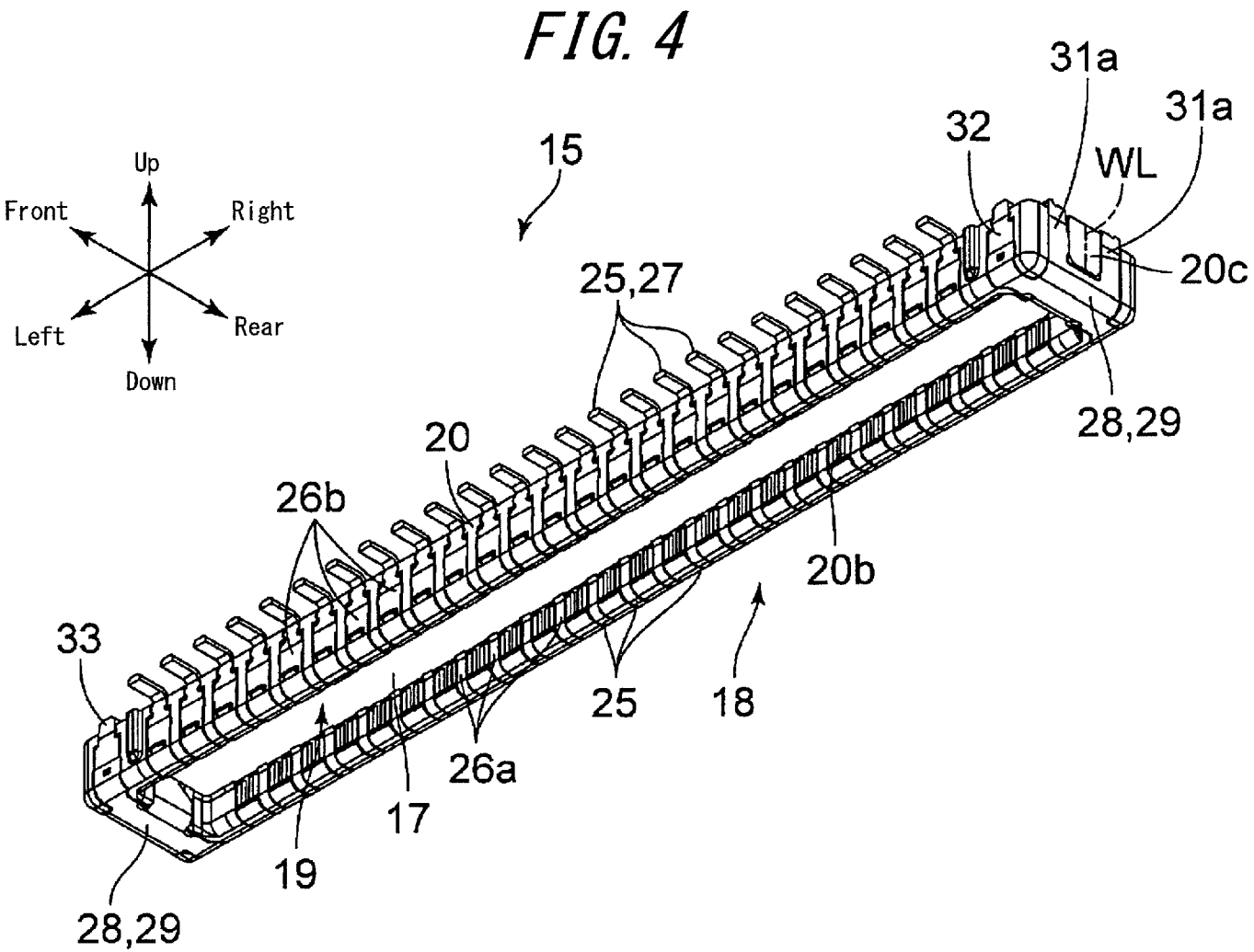
FIG. 4 is an exploded perspective view illustrating the plug connector, viewed from below.
Figure 13A:
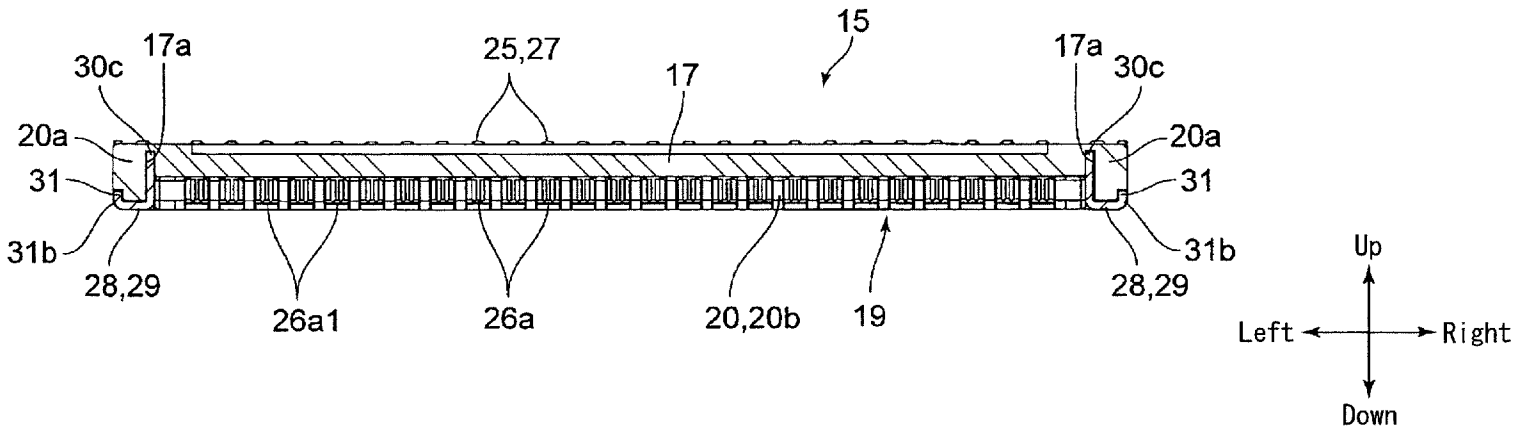
FIG. 13A is a cross-sectional view taken from line XIIIa-XIIIa of FIG. 12.
Figure 13B:
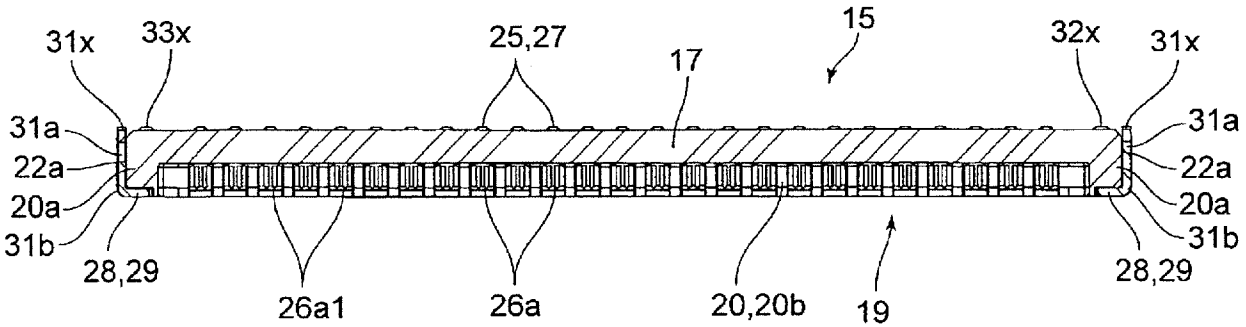
FIG. 13B is a cross-sectional view taken from line XIIIb-XIIIb of FIG. 12.

A space defined by the top plate 17 and the annular wall 20 forms an engagement recess 19 (see FIGS. 2, 4, and 13). On the front and rear of the longitudinal walls 20*b* of the annular wall 20, a number of contact mounting grooves 21 having a substantially U-shaped cross-section across front, rear, and bottom surfaces are arranged concavely in the left-right direction (see FIG. 1 and FIG. 2).

Figure 9A:
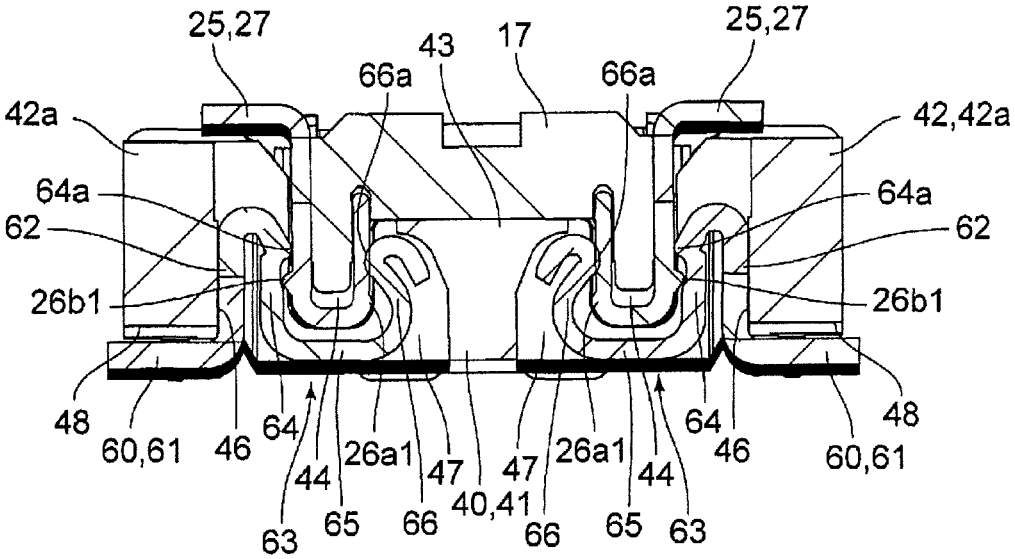
FIG. 9A is a cross-sectional view taken from line IXa-IXa of FIG. 8B.
Figure 11A:
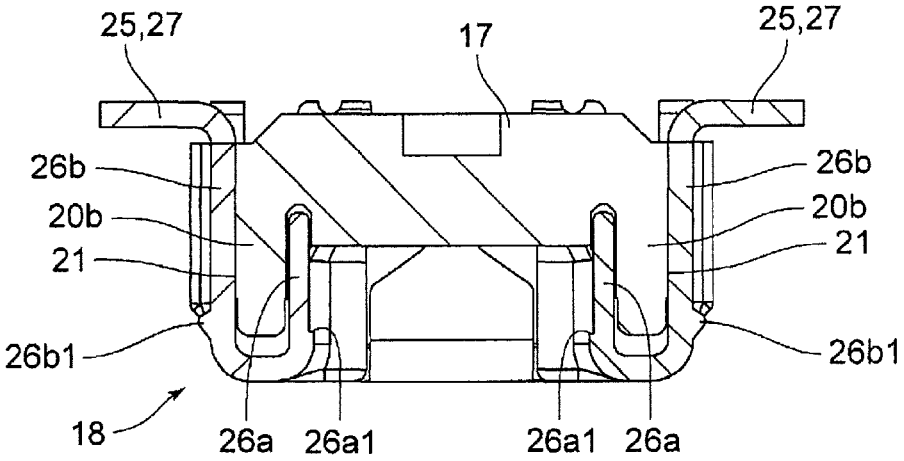
FIG. 11A is a cross-sectional view taken from line XIa-XIa of FIG. 10A.

The plug contacts 25 are each formed by stamping a thin plate of a copper alloy (e.g., phosphor bronze, beryllium copper, titanium copper, and Corson copper) having a spring-like elasticity into the shape illustrated in the figures. The plug contacts 25 each have a gold-plated or a tin-plated surface. The plug contacts 25 each include an inner contact portion 26*a* that extends in the up-down direction and constitutes an inner portion of a main body having a substantially U-shape in cross-section, an outer contact portion 26*b* that extends in the up-down direction and constitutes an outer portion of the main body, and a tail portion 27 that extends substantially horizontally from an upper end of the outer contact portion 26*b*. Further, a first plug side projection 26*b*1 (plug side projection) is formed in the vicinity of a lower end of a surface of the outer contact member 26*b*, and a second plug side projection 26*a*1 (plug side projection) is formed in the vicinity of a lower end of a surface of the inner contact member 26*a* (see FIG. 1, FIG. 2, and FIG. 9A). As illustrated in FIG. 9A and FIG. 11A, the second plug side projection 26*a*1 is located below the first plug side projection 26*b*1. The plug contact 25, excluding the tail portion 27, is press-fitted in the contact mounting groove 21 in a fixed manner (see FIG. 11A). The left and right side surfaces of the inner contact member 26*a* and the outer contact member 26*b* are provided with locking projections which engage an inner surface of the contact mounting groove 21. An upper end of the tail portion 27 of each of the plug contacts 25 slightly protrudes upward from an upper end surface of the top plate 17 (see FIG. 4).

Figure 14A:
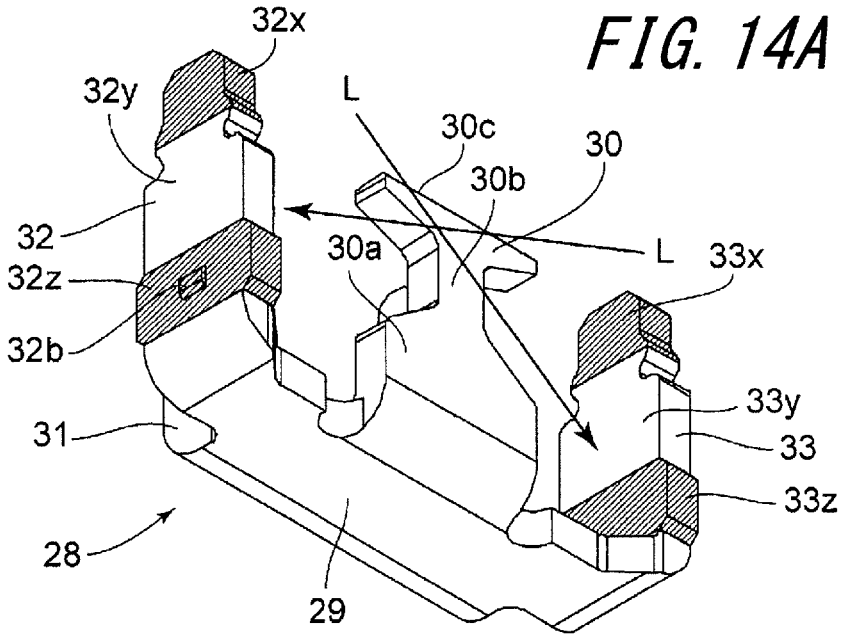
FIG. 14A is a magnified perspective view of a plug connector fixing bracket.
Figure 14B:
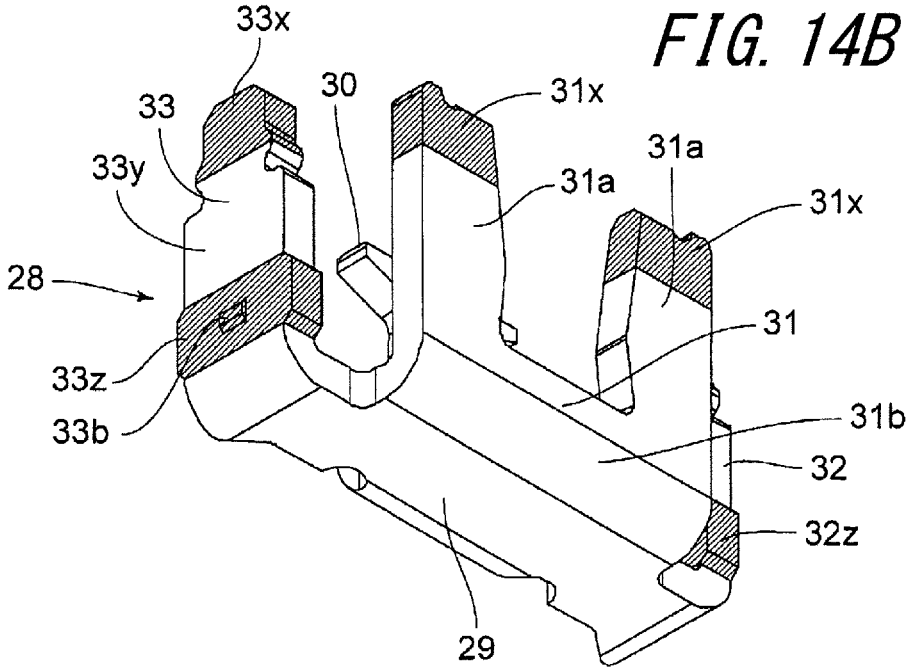
FIG. 14B is a magnified perspective view of the plug connector fixing bracket viewed from a different direction.

The plug connector fixing bracket 28 having a shape as illustrated in detail in FIGS. 14A and 14B is formed by pressing a metal sheet into the shape as illustrated in the figures. This metal sheet may be a thin sheet of a copper alloy (e.g., phosphor bronze, beryllium copper, titanium copper, and Corson copper), similarly to the plug contact 25.

The plug connector fixing bracket 28 includes a receiving surface 29 having a flat-plate shape that faces a bottom surface (an end surface) of the transverse wall 20*a*, a transverse inner wall 30 that bends from the receiving surface 29 and extends along an inner surface of the transverse wall 20*a*, a transverse outer wall 31 that bends from the receiving surface 29 and extends along an outer surface of the transverse wall 20*a*, and a pair of longitudinal outer walls 32, 33 that bends from the receiving surface 29 and extends along outer surfaces of the longitudinal walls 20*b*. The pair of longitudinal outer walls 32, 33 each has identical (or symmetrical) shapes. The pair of longitudinal outer walls 32, 33 has a length in their longitudinal directions along the longitudinal wall 20*b* that is equal to or shorter than a length of the receiving surface 29 (between the transverse outer wall 31 and the transverse inner wall 30) in its widthwise direction (a longitudinal direction of the longitudinal wall 20*b*), that is, these lengths do not protrude from the receiving surface 29 in the left-right direction.

The transverse outer wall 31 includes a connecting wall 31*b* adjacent to the receiving surface 29, and a pair of separated walls 31*a* separated from each other in the front-rear direction from the connection wall 31*b*. That is, the receiving surface 29 and the pair of separated walls 31*a* are connected to each other via the connecting wall 31*b*. The pair of separated walls 31*a* each has identical (symmetrical) shapes in such a manner as to become symmetrical across the weld line WL when attached to the plug connector 15 (the plug insulator 16).

The transverse inner wall 30 includes, from the receiving surface 29 in order, a wide portion 30*a*, a narrow portion 30*b* with a width narrower than a width of the wide portion 30*a*, and a wide foot portion 30*c*.

The transverse outer wall 31 (the pair of separated walls 31*a*) and the longitudinal outer walls 32, 33 that bend from the receiving surface 29 and linearly extend (in a plane-shape or straight) with upper end portions (tip portions) thereof reaching (contacting) a substrate on which the plug connector 15 is mounted (a plug side circuit board). Thus, the plug connector fixing bracket 28 is configured to disperse a force applied to the receiving surface 29 between the plug side circuit board, and the transverse outer wall 31 and the longitudinal outer walls 32, 33 linearly extend from the receiving surface 29, thus improving load bearing.

The pair of longitudinal outer walls 32, 33 of the plug connector fixing bracket 28 each has identical or symmetrical shapes. The longitudinal outer walls 32, 33 each have a longitudinal length (a width) along the longitudinal wall 20*b* equal to or shorter than a longitudinal length (a width) of the receiving surface 29. Thus, deformation or collapse of the receiving surface 29 is suppressed.

Upper ends (top ends) of the transverse outer wall 31 (the separated walls 31*a*) each include a gold-plated portion 31*x*. The longitudinal outer walls 32, 33 include, in order from top to bottom, gold-plated portions 32*x*, 33*x*, solder wicking preventing sections (prevention bands) 32*y*, 33*y*, and gold-plated portions 32*z*, 33*z*. The solder wicking preventing sections 32*y*, 33*y* are formed by performing gold-plating on the longitudinal outer walls 32, 33 in their entirety and then partially removing the gold-plating portions with laser beam so as to expose a base (e.g., a Ni base). The gold-plated portions 32*z*, 33*z* of the pair of longitudinal outer walls 32, 33 include outer surfaces having conductive protrusions 32*b* and 33*b* formed thereon.

The gold-plated portions 32*z*, 33*z* function as conductive portions to contact a receptacle connector fixing bracket 50 and electrically connect thereto when the plug connector 15 and the receptacle connector 35 are fully connected. The plug connector fixing bracket 28 and the receptacle connector fixing bracket 50 may be used as a conductive path for a device that requires a high current.

The narrow portion 30*b* of the transverse inner wall 30 enables irradiation of a laser beam on the inner surfaces of the longitudinal outer walls 32, 33, such that the gold-plated portions on the inner surfaces are removed to form the solder wicking preventing portions 32*y*, 33*y*. That is, the narrow portion 30*b* corresponds to the heights of the solder wicking preventing portions 32*y*, 33*y* that are positioned closer to the receiving surface 29 than the gold-plated portions 32*x*, 33*x* of the pair of longitudinal outer walls 32, 33 to the receiving surface 29 when the plug connector 15 is mounted on the plug side circuit board.

Figure 11B:
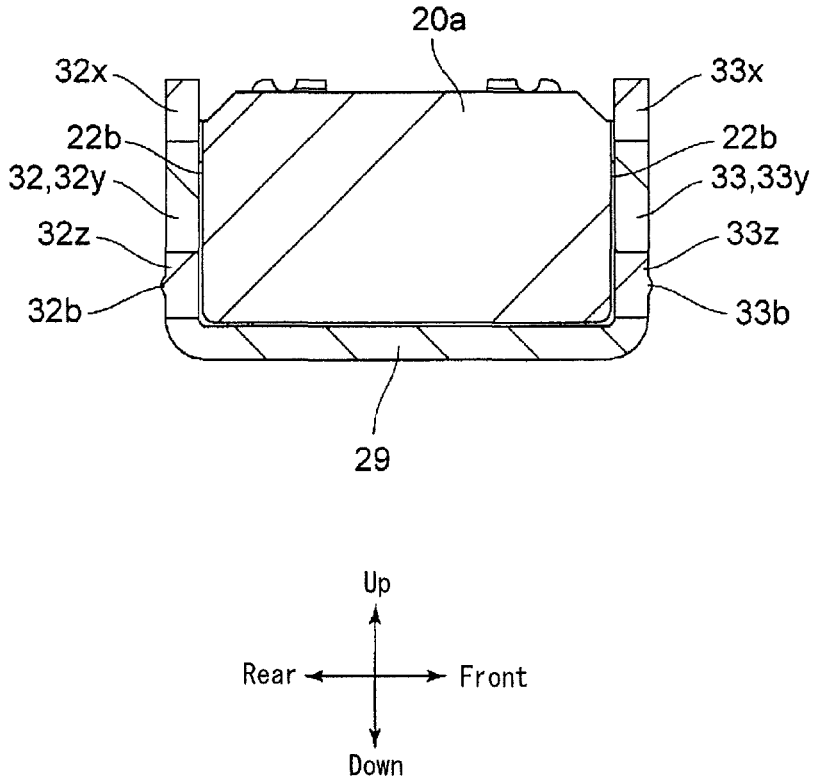
FIG. 11B is a cross-sectional view taken from line XIb-XIb of FIG. 10A.
Figure 12:
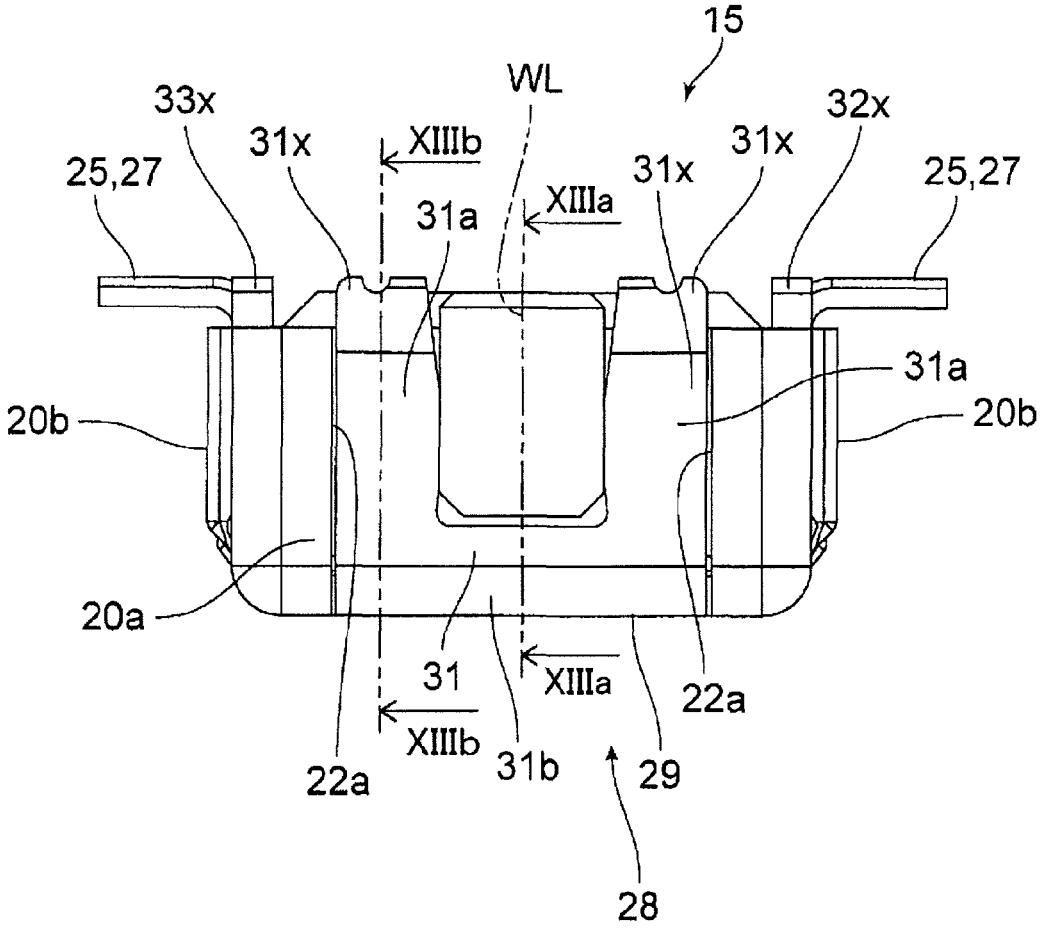
FIG. 12 is a side view of the plug connector.

A pair of front and rear fixing bracket attachment grooves 22*a* into which the pair of separated walls 31*a* is accommodated is recessed in the transverse wall 20*a* of the annular wall 20 on the left and right sides (see FIG. 1, FIG. 2, FIG. 12, and FIG. 13B). Fixing bracket attachment grooves 22*b* into which the longitudinal outer walls 32, 33 are accommodated are recessed in portions of the longitudinal walls 20*b* in the vicinities of the transverse wall 20*a* on the left and right sides (i.e., front and rear end faces of the transverse wall 20*a*) (see FIG. 1, FIG. 2, and FIG. 11B). A bottomed hole 17*a* is formed in the top plate 17 into which the wide foot 30*c* is fitted (see FIG. 13A). The pair of fixing bracket grooves 22*a* arranged in the front-rear direction is formed across a center portion of the transverse wall 20*a* and located across the weld line WL, which may result from a normal molding process. The bottomed hole 17*a* may be a through hole for allowing the wide foot portion 30*c* to contact the plug side circuit board. The wide foot 30*c* and the bottomed hole 17*a* function to position the transverse inner walls 30, or to prevent scratching or deformation of the transverse inner wall 30 when the plug connector 15 is attached to or detached from the receptacle connector 35.

The transverse inner wall 30 and the transverse outer wall 31 (the pair of divided walls 31*a*) extend from the receiving surface 29 and support the transverse wall 20*a* of the annular wall 20 of the plug insulator 16 from inside and outside. The longitudinal outer walls 32, 33 extending from the receiving surface 29 support outer surfaces (outer surfaces positioned in the front-rear direction) of the longitudinal walls 20*b* at positions corresponding to an extending direction of the transverse wall 20*a*. Thus, the receiving surface 29 is hard to deform, preventing the plug insulator 16 (the top plate 17 and the transverse wall 20*a*) from being crushed (destroyed). Further, the pair of separated walls 31*a* of the transverse outer wall 31 is positioned across the weld line WL when fitted in the pair of fixing bracket grooves 22*a* in a fixed manner, preventing the transverse wall 20*a* from separating (breaking) from the weld line WL in the front-rear direction. That is, even when the weld line WL is formed on the transverse wall 20*a*, the pair of separated walls 31*a* is fitted in the fixing bracket grooves 22*a* formed at the outer left and right portions of the transverse wall 20*a*, and the longitudinal outer walls 32, 33 are fitted in the fixing bracket grooves 22*b* formed at the outer front and rear portions of the longitudinal walls 20*b*. Thus, the weld line WL is sandwiched from front and rear sides thereof, preventing the plug insulator 16 (the top plate 17 and the transverse wall 20*a*) from breaking from the weld line WL.

The plug connector 15 described above is mounted on a mounting surface formed on one of the surfaces of the circuit board (a rigid substrate or the plug connector circuit board that are not illustrated in the figures). In particular, the tail portion 27 of each plug contact 25 is soldered (reflow-soldered) to a circuit pattern (not illustrated) formed on the mounting surface (a bottom surface) of the plug connector circuit board. The gold-plated portions 31*x*, 32*x*, and 33*x* at top ends of the separated wall 31*a* and the longitudinal outer walls 32, 33 of each of the plug connector fixing brackets 28 are soldered (reflow-soldered) to a conductive pattern (not illustrated) formed on the mounting surface. The mounting surface of the circuit board has electronic components (e.g., a high-performance module, a semiconductor, a large-capacity memory, etc.) other than the plug connector 15 mounted thereon.

Now, a configuration of the receptacle connector 35 will be described in detail, referring mainly to FIG. 5 to FIG. 9. The receptacle connector 35 includes, as main components, a receptacle insulator 40, a pair of receptacle connector fixing brackets 50, and receptacle contacts 60 (a receptacle contact group) as many as the plug contact 25.

The receptacle insulator 40 is a rod-like member made of synthetic resin having insulating and heat-resistant properties and extends in the left-right direction as illustrated in FIG. 5 to FIGS. 9A and 9B. The receptacle insulator 40 includes a bottom plate 41 constituting a bottom, a outer peripheral wall 42 having an annular shape with a rectangular shape in a plan view and protruding upward from the entire periphery of an upper surface of the bottom plate 41, and an engaging projection 43 that protrudes upward from a center of the front-rear direction of the upper surface of the bottom plate 41 and extends in the left-right direction from the center (see FIG. 9A). The outer peripheral wall 42 includes a pair of transverse walls 42*a* positioned in the left-right direction and a pair of longitudinal walls 42*b* positioned in the front-rear direction and connecting front ends and rear ends of the pair of transverse walls 42*a* together. The engaging projection 43 is formed at a predetermined distance from the outer peripheral wall 42 (the transverse walls 42*a* and the longitudinal walls 42*b*). An engagement recess 44 having an annular shape is formed between the outer peripheral wall 42 and the engaging projection 43.

Outer peripheral surfaces of the transverse walls 42*a* of the outer peripheral wall 42 on left and right sides each include a fixing bracket fitting groove 45*a* in the form of a recess. Left and right end portions of the outer peripheral surface of the longitudinal walls 42*b* positioned on the front and rear sides each include a fixing bracket fitting groove 45*b* in the form of a recess. Further, left and right end portions of inner surfaces of the longitudinal walls 42*b* positioned on the front and rear sides each include a pair of receiving grooves 45*c* in the form of recesses.

On the inner peripheral surface of the longitudinal walls 42*b* of the outer peripheral wall 42 arranged on the front and rear sides, a number of mounting grooves 46 (corresponding to the number of plug contacts 25) extending in the up-down direction are arranged in the left-right direction through the bottom plate 41 (see FIG. 5, FIG. 7, and FIG. 9A). Further, on front and rear surfaces of the bottom plate 41 and the engaging projection 43 positioned between the longitudinal walls 42*b* arranged on the front and rear sides and the engaging projection 43, a deformation permissible groove 47 continuous to a corresponding one of the mounting grooves 46 is formed through the bottom plate 41 (see FIG. 9A). Front and rear edges of the bottom plate 41 (portions coupled to lower end portions of the longitudinal walls 42*b* on the front and rear sides) includes a tail fitting groove 48 in the form of a recess continuous to the mounting groove 46 and a deformation permissible groove 47 (see FIG. 9A).

The pair of receptacle connector fixing brackets 50 arranged on left and right sides has a symmetrical shape in the front-rear direction. The receptacle connector fixing brackets 50 are each obtained through the press-forming of a metal sheet as with the plug connector fixing bracket 28, and has a gold-plated or a tin-plated portion on its surface. The receptacle connector fixing bracket 50 includes a transverse fixing portion 51 extending in the front-rear direction, longitudinal fixing portions 52 extending in the left-right direction from either end of the transverse fixing portion 51, a transverse tail portion 53 extending substantially downward from an outer peripheral edge of the transverse fixing portion 51, a longitudinal tail portion 54 extending substantially downward from an outer peripheral edge of the longitudinal fixing portion 52, a fixing bracket elastic deformable portion 55 extending obliquely downward from an inner peripheral edge of the longitudinal fixing portion 52, and a fixing bracket elastic deformable portion 57 extending substantially downward from an inner peripheral edge of the transverse fixing portion 51 (see FIG. 6). The fixing bracket elastic deformable portion 55 bends at its portion near its lower end, where conductive recesses 55*a* are formed in a manner corresponding to the conductive projections 32*b* and 33*b* of the plug connector fixing bracket 28 (see FIG. 9B). The fixing bracket elastic deformable portion 57 bends at its portion near its lower end, where a protruding contact portion (not illustrated) is formed. Further, the fixing bracket elastic deformable portions 55 and 57 are elastically deformable in a substantially front-rear direction and a substantially left-right direction (a direction orthogonal to a fitting direction of the annular projection 18 in the engagement recess 44).

The receptacle connector fixing brackets 50 arranged on the left and right sides are fixed to the receptacle insulator 40 in such a manner that the transverse fitting portions 51 are placed on upper surfaces of the transverse walls 42*a* arranged on the left and right sides and the longitudinal fitting portions 52 are placed on ends of the longitudinal wall 42*b*, while the transverse tail portion 53 is pressed into the fixing bracket fitting groove 45*a* in a fixed manner and the longitudinal tail portions 54 on the left and right sides are pressed into the fixing bracket fixing grooves 45*b* arranged on the left and right sides in a fixed manner.

Figure 9B:
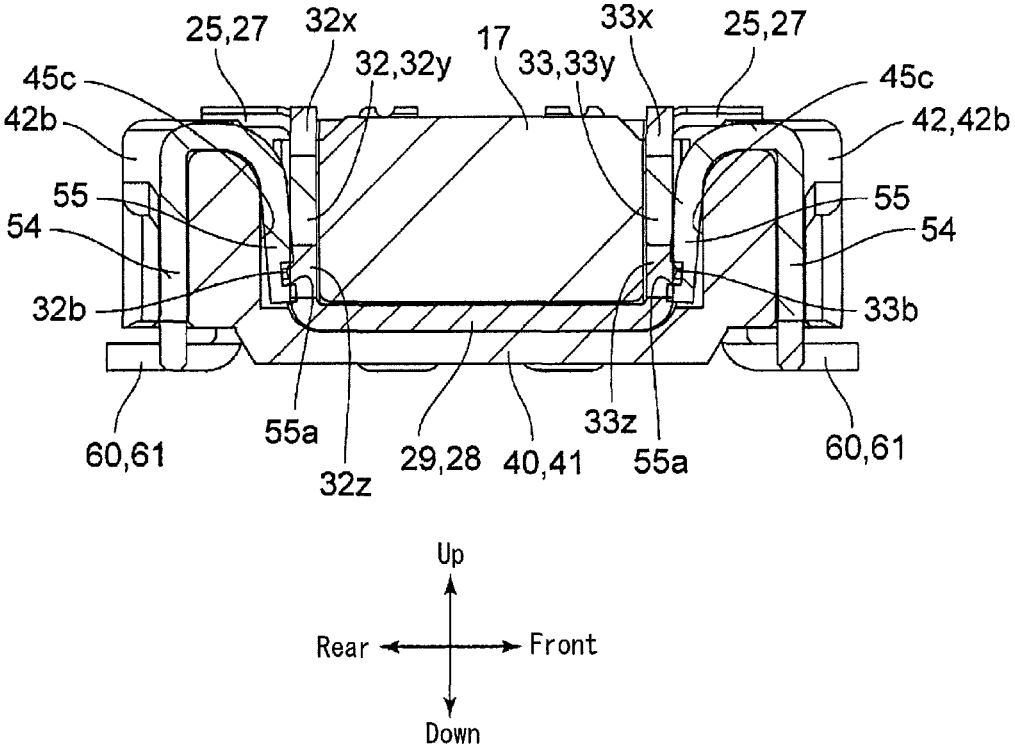
FIG. 9B is a cross-sectional view taken from line IXb-IXb of FIG. 8B.
Figure 10A:
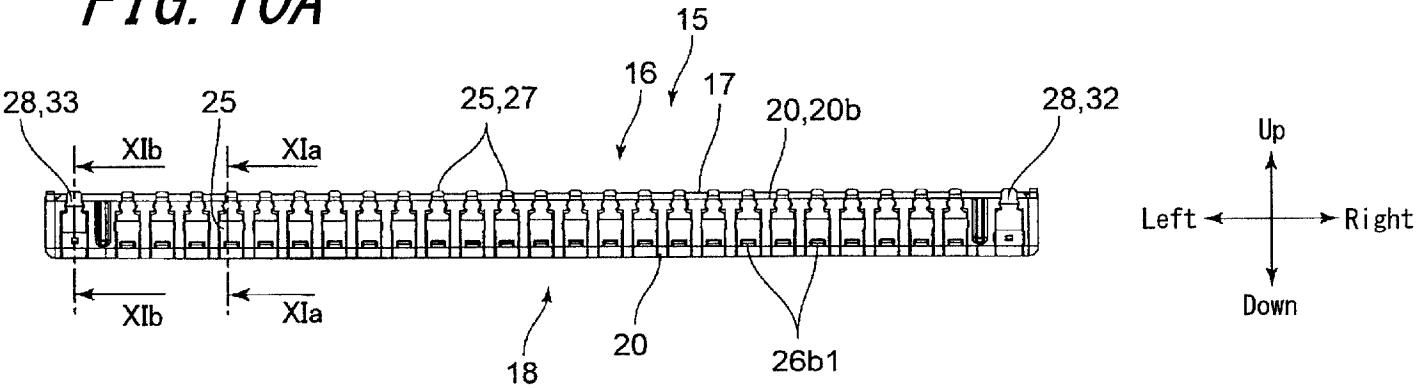
FIG. 10A is an elevation view of the plug connector.
Figure 10B:
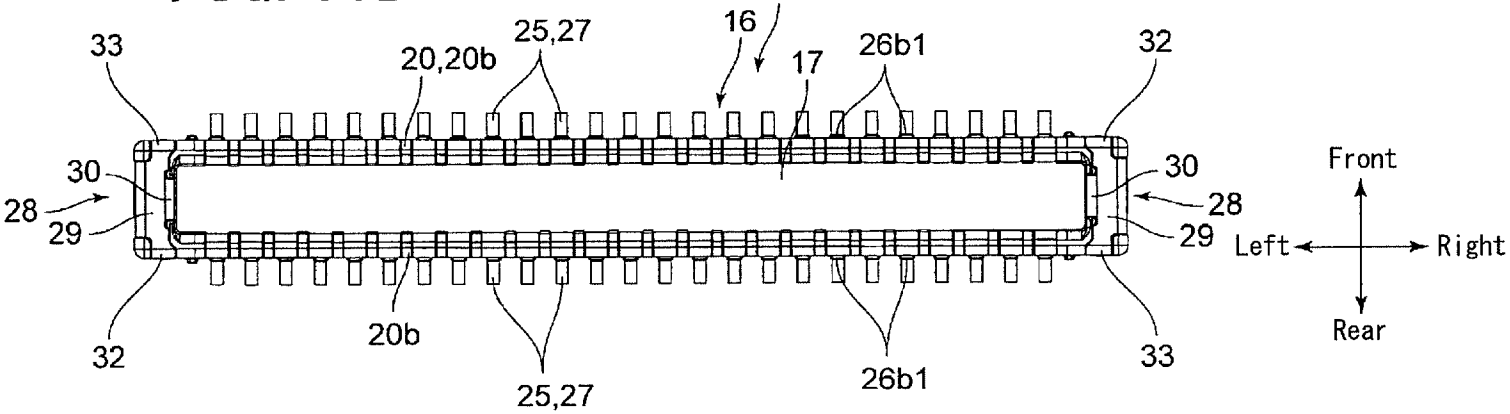
FIG. 10B is a plan view (a bottom view) of the plug connector.

When the receptacle connector fixing brackets 50 arranged on the left and right sides are fixed to the receptacle insulator 40 as described above, the fixing bracket elastic deformable portions 55 and 57 arranged on the left and right sides of the receptacle connector fixing bracket 50 are positioned within a corresponding one of the receiving grooves 45*c* while being spaced apart from an inner surface of the receiving groove 45*c* (see FIG. 9B). Thus, the fixing bracket elastic deformable portion 55 may elastically deform in the front-rear direction, and the fixing bracket elastic deformable portion 57 may elastically deform in the left-right direction.

Further, lower ends of the transverse tail portion 53 and the longitudinal tail portion 54 of the receptacle connector fixing bracket 50 protrude downward from a lower surface of the receptacle insulator 40.

The receptacle contacts 60 are each formed in a manner similar to the plug contact 25. The receptacle contacts 60 each include a tail portion 61 mounted on the mounting surface of the circuit board, a fixing member 62 extending upward from an inner end portion of the tail portion 61, and an elastic contact member 63 having a substantially S-shape continuous to an upper end portion of the fixing member 62. The elastic contact member 63 includes a hanging portion 64 extending downward from an upper end portion of the fixing member 62, an extending portion 65 extending substantially horizontally from a lower end portion of the hanging portion 64, and a rising portion 66 extending substantially upward from an inner end portion of the extending portion 65 (see FIG. 5 to FIG. 8 and FIG. 9A). Further, at an upper end portion of a surface of the hanging portion 64, a first receptacle connector projection 64*a* (a receptacle connector projection) protrudes toward the rising portion 66. In the vicinity of an upper end of the surface of the rising portion 66, a second receptacle connector projection 66*a* (a receptacle connector projection) protrudes toward the hanging portion 64. As illustrated in FIG. 9A, the second receptacle connector projection 66*a* is positioned lower than the first receptacle connector projection 64*a*. Also, a distance (a facing distance) in the front-rear direction between the first receptacle connector projection 64*a* and the second receptacle connector portion 66*a* when the receptacle contact 60 (the elastic contact member 63) is in a free state is shorter than a distance in the front-rear direction between a top end of the second plug connector projection 26*a*1 of the plug connector 15 and a top end of the first plug connector projection 26*b*1.

The receptacle contacts 60 are each attached to the receptacle insulator 40 being inserted into the mounting groove 46 and the deformation permissible groove 47 from under the receptacle insulator 40 while the fixing member 62 is pressed in (fixed to) the mounting groove 46. When the receptacle contact 60 (the fixing member 62) is fixed to the receptacle insulator 40 (the mounting groove 46), the elastic contact member 63 is spaced apart from an inner surface of the deformation permissible groove 47 (see FIG. 9A). Thus, the elastic contact member 63 is deformable in the front-rear direction within the deformation permissible groove 47. Also, the tail portion 61 of each of the receptacle contacts 60 is positioned under a bottom surface of the bottom plate 41 (see FIG. 5 to FIGS. 9A and 9B).

The receptacle connector 35 described above is fixed to (mounted on) the circuit board in an electrically conductive manner when the tail portion 61 of each of the receptacle contacts 60 is soldered to a circuit pattern (not illustrated) formed on the mounting surface of the circuit board (the rigid substrate or a receptacle connector circuit board) and, further, the lower portions of the transverse tail portion 53 and the longitudinal tail portion 54 of the receptacle connector fixing bracket 50 are soldered (reflow-soldered) to the conductive pattern formed on the mounting surface. Electronic components (e.g., CPU, a controller, a memory, etc.) other than the receptacle connector 35 are mounted on the mounting surface of the circuit board.

The plug connector 15 and the receptacle connector 35 that are configured as described above are assembled together in the following manner.

As illustrated in FIG. 5, first, a person (not illustrated) holds the plug connector 15 and the receptacle connector 35 with his/her hands (or holds the circuit board having the plug connector 15 mounted thereon and the circuit board having the receptacle connector 35 mounted thereon with his/her hands) and makes the plug connector 15 and the receptacle connector 35 surface each other in the up-down direction while matching front-rear positions and left-right positions thereof (see FIG. 5).

Then, the person moves the plug connector 15 downward (brings the plug connector 15 close to the receptacle connector 35) and fits the annular wall 20 of the annular projection 18 in the engagement recess 44.

Due to the downsizing of the plug connector 15 and the receptacle connector 35, misalignment occurs easily because it is difficult for a person to accurately oppose the plug connector 15 and the receptacle connector 35. When the plug connector 15 and the receptacle connect 35 are assembled together with misalignment, the plug connector fixing bracket 28 and the receptacle connector fixing bracket 50 contact each other at left and right end portions of the plug connector 15 and the receptacle connector 35. The plug connector fixing bracket 28 includes the receiving surface 29, the transverse inner wall 30 and the longitudinal outer walls 32, 33 that are integrally formed with, and bend from, the receiving surface 29, and thus has high rigidity with no risk for collapse. Also, the plug connector fixing bracket 28 includes the receiving surface 29, connecting portions connecting between the receiving surface 29 and the transverse inner wall 30, the transverse outer wall 31, and the longitudinal outer walls 32, 33, or the transverse inner wall 30, the transverse outer wall 31, and the longitudinal outer walls 32, 33 contact metal portions of the receptacle connector fixing bracket 50. Thus, the transverse wall 20*a* is prevented from breaking or collapsing due to the weld line WL. Further, the transverse wall 20*a* has the inner and outer end surfaces supported by the receiving surface 29, the transverse inner wall 30, the transverse outer wall 31, and the longitudinal outer walls 32, 33 of the plug connector fixing bracket 28. Thus, the transverse wall 20*a* is prevented from being scratched by the receptacle connector fixing bracket 50.

When the plug connector 15 is moved downward (when the annular wall 20 is moved deeper in the engagement recess 44), the lower end portion of each of the plug contacts 25 of the plug connector 15 contacts, from above, the upper end portions of the hanging portion 64 and the rising portion 66 of each of the receptacle contacts 60 of the receptacle connector 35.

When the plug connector 15 is moved further downward, a lower end portion of each of the plug contacts 25 of the plug connector 15 enters between the hanging portion 64 and the rising portion 66 of each of the receptacle contacts 60, elastically deforming the elastic contact member 63 in such a manner as to push-open a gap between the hanging portion 64 and the rising portion 66. In this way, the first plug connector projection 26*b*1 of each of the plug contacts 25 laterally engages with the first receptacle connector projection 64*a* of the hanging portion 64 of each of the receptacle contacts 60 and, also, the second plug connector projection 26*a*1 of each of the plug contacts 25 engages with the second receptacle connector projection 66*a* of the rising portion 66 from its above. This makes the plug connector circuit board and the receptacle connector circuit board electrically connectable to each other via the plug contact 25 and the receptacle contact 60.

In this state, when the plug connector 15 is move further downward, the first plug connector projection 26*b*1 moves the first receptacle connector projection 64*a* downward (in a direction in which the annular projection 18 fits in the engagement recess 44), causing the first receptacle connector projection 64*a* to contact a surface of the outer contact member 26*b* and the second plug connector projection 26*a*1 to laterally engage with the second receptacle connector projection 66*a* of the rising portion 66. When the plug connector 15 is further moved slightly downward, the second plug connector projection 26*a*1 of each of the plug contacts 25 moves the second receptacle connector projection 66*a* of the rising portion 66 downward, causing the second receptacle connector projection 66*a* to contact a surface of the inner contact member 26*a*.

At this point, the plug connector fixing bracket 28 of the plug connector 15 contacts the receptacle connector fixing bracket 50 (the fixing bracket elastic deformable portions 55 and 57) of the receptacle connector 35.

When the plug connector 15 is moved further downward, the inner contact member 26*a* and the outer contact member 26*b* of the plug contact 25 slide on the second receptacle connector projection 66*a* and the first receptacle connector projection 64*a* of the receptacle contact 60, respectively. In this way, the plug connector 15 and the receptacle connector 35 are fully assembled together.

After being fully connected together or built into a product, the plug connector 15 and the receptacle connector 35 may receive vibration or may be dropped, thereby applying a strong external force to the transverse wall 20*a*. The transverse wall 20*a* is vulnerable to external forces in a pitch direction. In the plug connector 15 according to the present embodiment, however, the transverse wall 20*a* is surrounded by the receiving surface 29 of the plug connector fixing bracket 28, as well as the transverse inner wall 30, the transverse outer wall 31, and the longitudinal outer walls 32, 33 that are formed in four directions from the receiving surface 29. Thus, the risk of the transverse wall 20*a* being crushed by an external force is low.

Concurrently with a connection step of the receptacle contact 60 and the plug contact 25 as described above, the plug connector fixing bracket 28 of the plug connector 15 and the receptacle connector fixing bracket 50 of the receptacle connector 35 start contacting each other. In a state where the connection is completed, the fixing bracket elastic deformable portion 55 corresponding to the longitudinal outer walls 32, 33 (the gold-plated portions 32*z* and 33*z*) of the plug connector fixing bracket 28 is elastically deformed in an outward direction (in a forward direction for the fixing bracket elastic deformable portion 55 on the front side and in a rearward direction for the fixing bracket elastic deformable portion 55 on the rear side). Also, the fixing bracket elastic deformable portions 57 corresponding to the pair of separated walls 31*a* is elastically deformed in an outward direction (in a leftward direction for the fixing bracket elastic deformable portion 57 on the left side, and a rightward direction for the fixing bracket elastic deformable portion 57 on the right side) (see FIG. 9B). As a result, the fixing bracket elastic deformable portions 55 on the front and rear sides and the fixing bracket elastic deformable portions 57 on the left and right sides hold the front, rear, left, and right sides of the plug connector 15 while generating a biasing force in a direction bringing the fixing bracket elastic deformable portions 57 close to each other. Accordingly, the biasing force generated at this point by the fixing bracket elastic deformable portions 55 on the front and rear sides and the fixing bracket elastic deformable portions 57 on the left and right sides is not a biasing force in a direction acting to remove the plug connector 15 from the receptacle connector 35. Accordingly, unless the plug connector 15 is moved upward relative to the receptacle connector 35, the plug connector 15 and the receptacle connector 35 remain fully assembled together. In this fully assembled state, further, the conducting protrusions 32*b* and 33*b* of the longitudinal outer walls 32, 33 of the plug connector fixing bracket 28 are fitted in the conductive recesses 55*a* of the fixing bracket elastic deformable portion 55 of the receptacle connector fixing bracket 50, thus ensuring electric conductivity between the fixing brackets of the plug connector fixing bracket 28 and the receptacle connector fixing bracket 50 and preventing separation thereof from each other.

In the plug connector 15 according to the present embodiment, the transverse walls 20*a* (and the top plate 17 to which the transverse wall 20*a* is connected) on the left and right sides of the annular wall 20 of the plug insulator 16 are each supported from inside and outside by the transverse inner wall 30 and the pair of separated wall portions 31*a* of the transverse outer wall 31 that extends from the receiving surface 29 of the plug connector fixing bracket 28, while being supported at the front and rear end portions thereof (at front and rear sides of the longitudinal wall 20*b* in the vicinity of the front and rear end portions). Thus, the plug connector 15 is hard to collapse (break).

Also, in the plug connector 15 according to the present embodiment, even when the weld lines WL occurs at left and right end portions of the top plate 17 and the left and right end portions (the transverse walls 20*a*) of the annular wall 20 during injection molding of the plug insulator 16, since the pair of separated wall portions 31*a* of the plug connector fixing bracket 28 are fitted in the pair of fixing bracket grooves 22*a* formed across the weld line WL, the transverse wall 20*a* does not break from the weld line WL. Further, in the plug connector 15 according to the present embodiment, the transverse wall 20*a* of the plug insulator 16 is held on its front and rear sides by the longitudinal outer walls 32, 33 of the plug connector fixing bracket 28, thus preventing, as a backup measure, the transverse wall 20*a* from breaking from the weld line WL.

In the plug connector 15 according to the present embodiment, an outer peripheral lower end portion of the annular projection 18 of the plug connector 15, a portion connecting between the outer contact member 26*b* and the inner contact member 26*a* of the plug contact 25, and the connecting wall portion 31*b* connecting the receiving surface 29 of the plug connector fixing bracket 28 and the pair of separated wall portions 31*a* are all formed in an R-shape. Also, in the receptacle connector 35 according to the present embodiment, an inner peripheral upper end portion of the annular wall 20 of the receptacle connector 35, a portion connecting between the fixing member 62 of the receptacle contact 60 and the hanging portion 64, a portion connecting between the transverse fixing portion 51 of the receptacle connector fixing bracket 50 and the fixing bracket elastic deformable portion 57, and a portion connecting between the longitudinal fixing portion 52 and the fixing bracket elastic deformable portion 55 are all formed in the R-shape. Accordingly, when the plug connector 15 and the receptacle connector 35 are assembled together, the portions in the R-shape contact with one another first, facilitating the assembly of the plug connector 15 and the receptacle connector 35.

Although the present disclosure is described above on the basis of the embodiment illustrated by the figures, the present disclosure is not limited thereto and can be implemented by various modifications.

For example, in the embodiment illustrated by the figures, the plug connector fixing bracket 28 and the receptacle connector fixing bracket 50 are symmetric to each other with respect to a plane that passes through the center of the front-rear direction while being parallel to the up-down direction and perpendicular to the left-right direction. However, the plug connector fixing bracket 28 and the receptacle connector fixing bracket 50 may have shapes asymmetrical on left and right sides. Also, although the plug connector fixing brackets 28 and the receptacle connector fixing brackets 50 respectively have shapes identical to or symmetrical with each other on left and right sides, their shapes may differ between the left side and the right side.

One of the plug connector 15 and the receptacle connector 35 may be connected to the corresponding circuit board in what is called an RA (right angle) mode.

Also, the plug connector fixing bracket 28 and the receptacle connector fixing bracket 50 may be connected to a power supply circuit coupled to a power source (not illustrated).

Further, a circuit board such as FPC (a flexible printed circuit board) other than the rigid substrate may be coupled to the plug connector 15 or the receptacle connector 35.

In the above embodiment, the transverse outer wall 31 of the fixing bracket 28 includes the pair of separated wall portions (separated walls) 31*a*. However, the transverse inner wall 30 of the plug connector fixing bracket 28, or both the transverse inner wall 30 and the transverse outer wall 31 of the plug connector fixing bracket 28 may have a pair of separated wall portions (separated walls).

So far as at least one of the transverse inner wall 30 and the transverse outer wall 31, and the longitudinal outer walls 32, 33 contact the plug connector circuit board, the plug connector fixing bracket 28 may have a configuration in which, for example, a top portion of the transverse inner wall 30 in place of the transverse outer wall 31 extends through the top plate 17 and contacts the plug connector circuit board, or both top portions of the transverse inner walls 30 in place of the transverse outer walls 31 contact the plug connector circuit board.

The pair of separated wall portions 31*a* (separated walls) of the plug connector fixing bracket 28 may be configured as, for example, an integral transverse outer wall formed by extending the transverse outer wall 31 upward, or may be configured to have the same shape as the transverse inner wall 30.

REFERENCE SIGNS LIST

10 connector
15 plug connector
16 plug insulator
17 top plate
17*a* bottomed hole
18 annular projection
19 engagement recess
annular wall
20*a* transverse wall (left and right walls)
20*b* longitudinal wall (front and rear walls)
21 contact mounting groove
22*a* fixing bracket attaching groove
22*b* fixing bracket attaching groove
25 plug contact (plug contact group)
26*a* inner contact member
26*a*1 second plug connector projection (plug connector projection)
26*b* outer contact member
26*b*1 first plug connector projection (plug connector projection)
27 tail portion
28 plug connector fixing bracket
29 receiving surface
30 transverse inner wall
30*a* wide portion
30*b* narrow portion
30*c* wide foot
31 transverse outer wall
31*a* separated wall portion (separated wall)
31*b* connecting wall
31*x* gold-plated portion
32, 33 longitudinal outer wall
32*b*, 33*b* conductive protrusion
32*x*, 33*x* gold-plated portion
32*y*, 33*y* solder wicking preventing portion (preventing band)
32*z*, 33*z* gold-plated portion
40 receptacle connector
41 receptacle insulator
41 bottom plate
42 outer peripheral wall
42*a* transverse wall
42*b* longitudinal wall
43 engaging projection
44 engagement recess
45*a*, 45*b* fixing bracket attaching groove
45*c* receiving groove
46 mounting groove
47 deformation permissible groove
50 receptacle connector fixing bracket
51 transverse fixing portion
52 longitudinal fixing portion
53 transverse tail portion
54 longitudinal tail portion
55 fixing bracket elastic deformable portion
55*a* conductive recess
57 fixing bracket elastic deformable portion
60 receptacle contact (receptacle contact group)
61 tail portion
62 fixing member
63 elastic contact member
64 hanging portion (first elastic deformable portion)
64*a* first receptacle connector projection (receptacle connector projection)
65 extending portion
66 rising portion (second elastic deformable portion)
66*a* second receptacle connector projection (receptacle connector projection)

The invention claimed is:

1. A plug connector attachable to and detachable from a receptacle connector including a receptacle insulator formed from a resin and having an annular outer peripheral wall forming an engagement recess on an inner peripheral side, and a receptacle contact group that is elastically deformable, mountable on a circuit pattern of a receptacle side circuit board and supported by the receptacle insulator, the plug connector comprising:

a plug insulator having an outer peripheral wall that includes a pair of longitudinal walls and a pair of transverse walls together constituting an annular projection to fit into the engagement recess;

a plug contact group arranged in a row and supported by the longitudinal walls of the outer peripheral wall, contacts the receptacle contact group when the annular projection is fit into the engagement recess, and is connected to a circuit pattern of a plug side circuit board; and a plug connector fixing bracket mounted on the transverse walls, wherein the plug connector fixing bracket includes a receiving surface facing a bottom surface of the transverse walls, a transverse outer wall and a transverse inner wall that bend from the receiving surface and respectively extend along an outer surface and an inner surface of the transverse walls, and a pair of longitudinal outer walls that bends from the receiving surface and extends along outer surfaces of the longitudinal walls, wherein one of the transverse outer wall and the transverse inner wall of the plug connector fixing bracket includes a pair of separated walls, that bend from the receiving surface, located across a center of a longitudinal direction of the transverse walls of the plug insulator, wherein the pair of transverse walls of the plug insulator each include a pair of fixing bracket mounting grooves to engage with a respective pair of separated walls, and wherein a portion of each transverse wall is located between a respective pair of fixing bracket mounting grooves and extends between a respective pair of separated walls, and wherein each of the pair of separated walls and the pair of longitudinal outer walls of the plug connector fixing bracket extend from the receiving surface over the plug insulator in a direction in which the plug connector fixing bracket is fixed to the plug insulator so as to be able to contact a mounting surface of a plug side circuit board.

2. The plug connector according to claim 1, wherein the pair of longitudinal outer walls of the plug connector fixing bracket has a length in a longitudinal direction along the longitudinal walls equal to or shorter than a length in the longitudinal direction between the transverse outer wall and the transverse inner wall.

3. The plug connector according to claim 1, wherein the transverse outer wall of the plug connector fixing bracket includes the pair of separated walls located across the center of the longitudinal direction of the transverse walls of the plug insulator.

4. The plug connector according to claim 1, wherein at least one of the transverse outer wall and the transverse inner wall and the pair of longitudinal outer walls bend from the receiving surface and linearly extend such that top end portions of the at least one of the transverse outer wall and the transverse inner wall and the pair of longitudinal outer walls contact the plug side circuit board.

5. The plug connector according to claim 1, wherein the plug insulator of the plug connector includes a pair of grooves to engage with the pair of longitudinal outer walls, respectively.

* * * * *